US007062792B2

(12) United States Patent
Jaunault et al.

(10) Patent No.: US 7,062,792 B2
(45) Date of Patent: Jun. 20, 2006

(54) AMBIDEXTROUS PROTECTIVE GLOVE

(75) Inventors: Philippe Jaunault, Villemoisan (FR); Sophie Jaunault, Villemoisan (FR)

(73) Assignee: Manulatex France, Champtoce sur Loire (FR)

( * ) Notice: Subject to any disclaimer, the term of this patent is extended or adjusted under 35 U.S.C. 154(b) by 23 days.

(21) Appl. No.: 10/480,001

(22) PCT Filed: Jun. 6, 2002

(86) PCT No.: PCT/FR02/01941

§ 371 (c)(1),
(2), (4) Date: May 3, 2004

(87) PCT Pub. No.: WO02/098249

PCT Pub. Date: Dec. 12, 2002

(65) Prior Publication Data

US 2004/0181848 A1 Sep. 23, 2004

(30) Foreign Application Priority Data

Jun. 6, 2001 (FR) ..... 01 07400

(51) Int. Cl.
*A41D 19/00* (2006.01)

(52) U.S. Cl. ..... 2/161.6; 2/16

(58) Field of Classification Search ..... 2/16, 2/20, 161.6; 24/41.1, 578.1, 578
See application file for complete search history.

(56) References Cited

U.S. PATENT DOCUMENTS 4,471,495 A * 9/1984 Kruse et al. ..... 2/162
5,054,126 A * 10/1991 Rivkin ..... 2/16
5,088,126 A * 2/1992 Mathis ..... 2/181
5,729,831 A 3/1998 Kuhlmann
5,894,602 A * 4/1999 Smith et al. ..... 2/159
6,076,190 A * 6/2000 Besson ..... 2/161.6
2004/0025223 A1* 2/2004 Jaunault et al. ..... 2/159

FOREIGN PATENT DOCUMENTS

| | | |
|---|---|---|
| DE | 93 13 344 | 11/1993 |
| DE | 299 10 449 | 8/1999 |
| FR | 2 729 274 | 7/1996 |

* cited by examiner

*Primary Examiner*—Katherine M. Moran
(74) *Attorney, Agent, or Firm*—Young & Thompson

(57) ABSTRACT

The invention concerns a protective glove consisting of a chain mail main part (2) designed to cover the user's hand and wrist, comprising a mounted cinching strap (5) located in a sheath (6) or in loops provided on the terminal edge (4), or proximate to said terminal edge (4). Said glove is characterised in that it comprises: at least first releasable catching means (11, 12) provided on the outside of the chain mail fabric, designed to co-operate with appropriate matching means (10) provided at one first end (5') of said strap (5), and at least two second releasable catching means (17, 18) symmetrically or substantially symmetrically opposite on the outside of the glove, one of which, depending on whether the glove is being used to protect the right hand or the left hand, is designed to co-operate with appropriate matching means (15) provided at the second end (5") of said strap (5), to lock tightly said strap (5). Thus said glove is adapted to be worn either on the right hand, or on the left hand, without requiring to be turned inside out.

20 Claims, 4 Drawing Sheets

AMBIDEXTROUS PROTECTIVE GLOVE

BACKGROUND OF THE INVENTION

This invention relates to a glove made of chain mail fabric, composed of an interlaced metal ring network, which is designed to protect the hand and possibly the forearm or the arm of an operator running the risk of being injured further to using sharp or cutting tools.

Gloves made of chain mail of this type are for example described in the documents FR-A-2 748 908, FR-A-2 753 883, FR-A-2 771 260, U.S. Pat. No. 5,054,126 or still DE-U-93 05286.3; they are in particular widespread in the meat industry, notably in the cutting stations.

Such gloves may be <<simple>> i.e. made of a main part designed to cover only the user's hand and wrist. In more sophisticated models, the portion which covers the wrist may be extended by a cuff-link made of plastic material or of chain mail fabric, covering the forearm and possibly the arm. In case when it is made of chain mail fabric, the protective cuff-link portion is fitted with plastic or metal longitudinal stiffeners to hold it correctly on the user's member without sagging on the wrist and the hand.

For good holding on the hand, the <<simple>> gloves are fitted with a cinching strap at the wrist; for protective cuff-link gloves made of chain mail, a first cinching strap on the wrist is generally associated with a second strap, of identical or different structure, provided at the end of the cuff-link.

For greater comfort, these gloves are shaped in order to match ideally the contour of the hand; moreover the adjustment and/or locking members of the cinching straps are adapted in order to be positioned above the wrist or the forearm.

But this involves quite generally providing different gloves to fit the right hands and the left hands of the users.

Gloves made of so-called <<ambidextrous>> chain mail have been designed (see notably the documents U.S. Pat. No. 5,054,126 or FR-A-2 771 260), but the corresponding ambidextrous character is obtained by turning the glove over; and it is then quite often necessary to provide holding and catching means for the cinching straps, on either side of the chain mail fabric (i.e. inside and outside the glove), which increases the complexity of manufacture of the product and which is detrimental because of the presence of bulges and/or protruding members.

SUMMARY OF THE INVENTION

This invention relates to a new structure of glove made of chain mail capable of fitting comfortably the right hand as well as the left hand of a user and this, without requiring turning the glove over.

The protective glove according to this invention is of the type consisting of a main part made of chain mail designed to cover the user's hand and wrist, possibly associated with an extension also made of chain mail designed to cover the forearm or still the arm; it includes a mounted cinching strap located in a sheath or in loops provided on the terminal edge of the glove, or close to this terminal edge. This glove is characterised in that it includes:

- at least one first releasable catching means provided on the outside of the chain mail fabric, designed to co-operate with appropriate matching means provided at one first end of said cinching strap, and
- at least two second releasable catching means, symmetrically or substantially symmetrically opposite on the outside of the glove, whereof the one, according to the usage of the glove for protecting a right hand or a left hand, is designed to co-operate with appropriate matching means arranged at the second end of said strap, for tightly locking said strap, such locking being preferably adjustable.

Such a glove structure may be thus used as well for the right hand as for the left hand, the positioning of the cinching strap being adapted consequently so that the locking means of the cinching system are arranged above the wrist or the forearm.

According to a first possible embodiment, the glove includes a first releasable catching means laid out in an opening provided in the sheath to form the inlet and the outlet of the strap, or between two loops making up the inlet and outlet members of said strap.

According to a second possible embodiment, the glove includes two first releasable catching means arranged inside the receiving sheath of the strap, on either side of the opening provided in said sheath to form the inlet and the outlet of said strap, or under two loops making up the inlet and outlet members of said strap.

Both second catching means intended for tight locking of the strap may be provided on the sheath or the receiving loops of the strap.

In an embodiment variation, both these second catching means are provided on the outside of the strap, running then through appropriate openings provided in the receiving sheath of said strap, or between two loops.

According to a particular embodiment, the glove made of chain mail according to this invention includes a portion of snap fastener provided in the opening of the receiving sheath of the strap, or between two loops, used for attaching one first end of said strap fitted with a matching portion of snap fastener; it includes also two other portions of snap fastener, symmetrically or substantially symmetrically opposite, laid out on the outside of said sheath or said loops, or on said strap, then running through openings provided in said sheath or between two loops, whereof the one co-operates with a matching portion of snap fastener positioned on an adjustable buckle integral with the second end of the strap.

According to another particular embodiment, the glove includes two identical portions of snap fastener provided in the receiving sheath of the strap, on either side of the opening provided in said sheath, or under two loops, whereof the one is used for attaching one first end of the strap fitted with a matching portion of snap fastener; it includes also two other portions of snap fastener symmetrically or substantially symmetrically opposite, laid out on the outside of said sheath or said loops, or on said strap, then running through openings provided in said sheath or between two loops, whereof the one co-operates with a matching portion of snap fastener positioned on an adjustable buckle integral with the second end of strap.

Still according to the invention within the framework of a glove fitted with an extension made of chain mail designed to cover the user's forearm or arm, the terminal strap defined above is associated with a second cinching strap laid out at the wrist; the glove then includes a first releasable catching means of a first end of the second strap, and a second releasable and adjustable catching means of the second end of said strap. In such a case, and according to a preferred embodiment, one of the ends of the second strap of wrist is fitted with two identical portions of snap fastener, mounted on either side of said strap; one of both these portions of snap fastener is intended to co-operate with one of two matching portions of snap fastener laid out symmetrically or substantially symmetrically on the outside of the glove, and the other portion of snap fastener is intended to co-operate with a matching portion of snap fastener laid out on an adjustable buckle integral with the second end of said second strap.

Preferably, the first releasable catching means of the cinching terminal strap are situated substantially in the extension of the glove finger designed to receive the auricular.

On the other hand, for equivalent comfort, regardless whether it is used for protecting a right hand or a left hand, the glove according to this invention possesses advantageously a plane of symmetry running through the axis of the five glove fingers.

Besides, for optimum safety, the terminal edge of the glove is in the form of a complete sleeve deprived of any lateral slit and slightly oversized with respect to the contour of the wrist, of the forearm or of the arm.

BRIEF DESCRIPTION OF THE DRAWINGS

But the invention will be still illustrated, without limitation thereto, by the following description of several particular embodiments, given solely for exemplification purposes and represented on the appended drawings whereon.

DETAILED DESCRIPTION OF THE PREFERRED EMBODIMENTS

Figure 1:
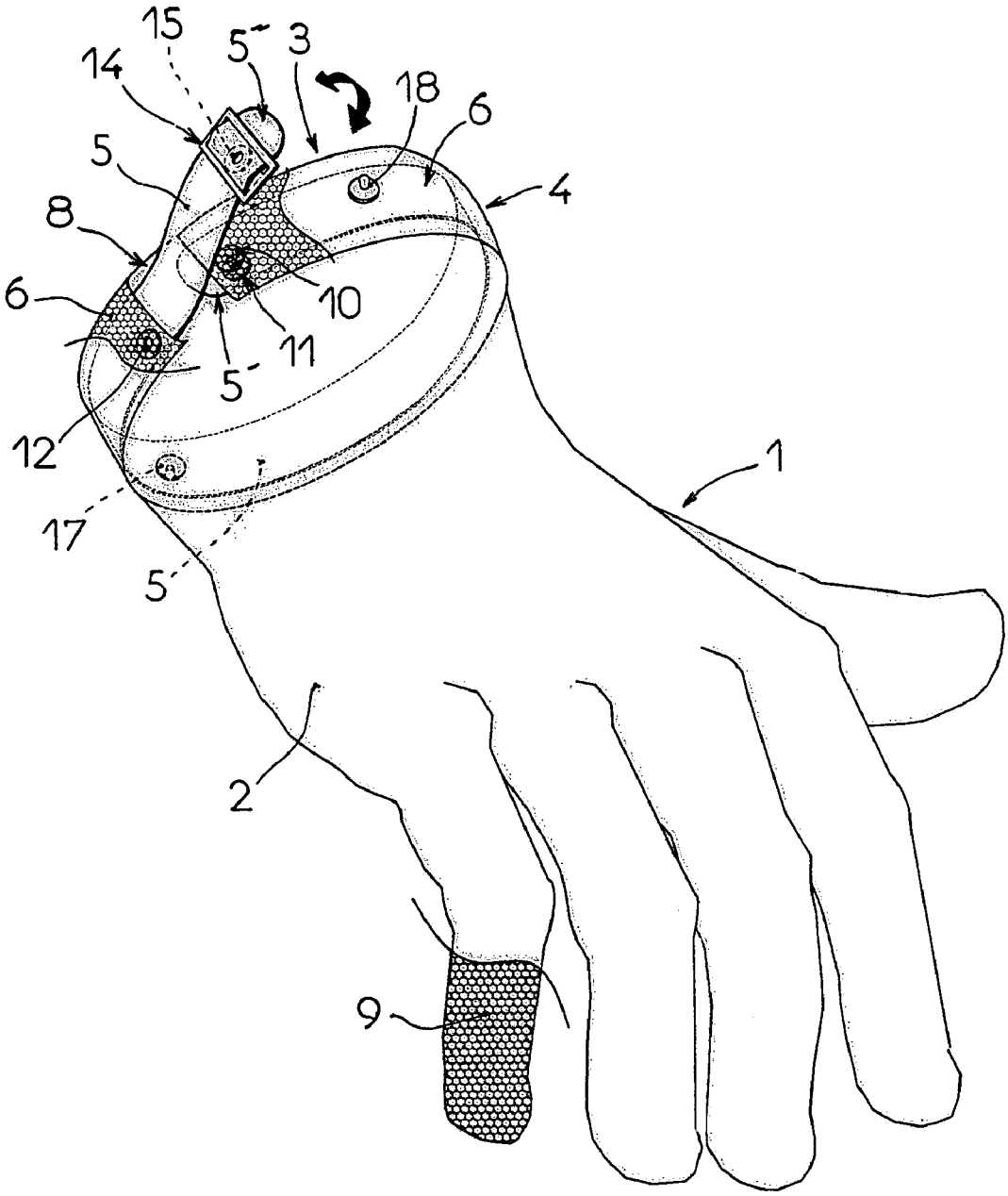
FIG. 1 is a perspective view of a <<simple>> glove made of chain mail according to this invention.
Figure 2:
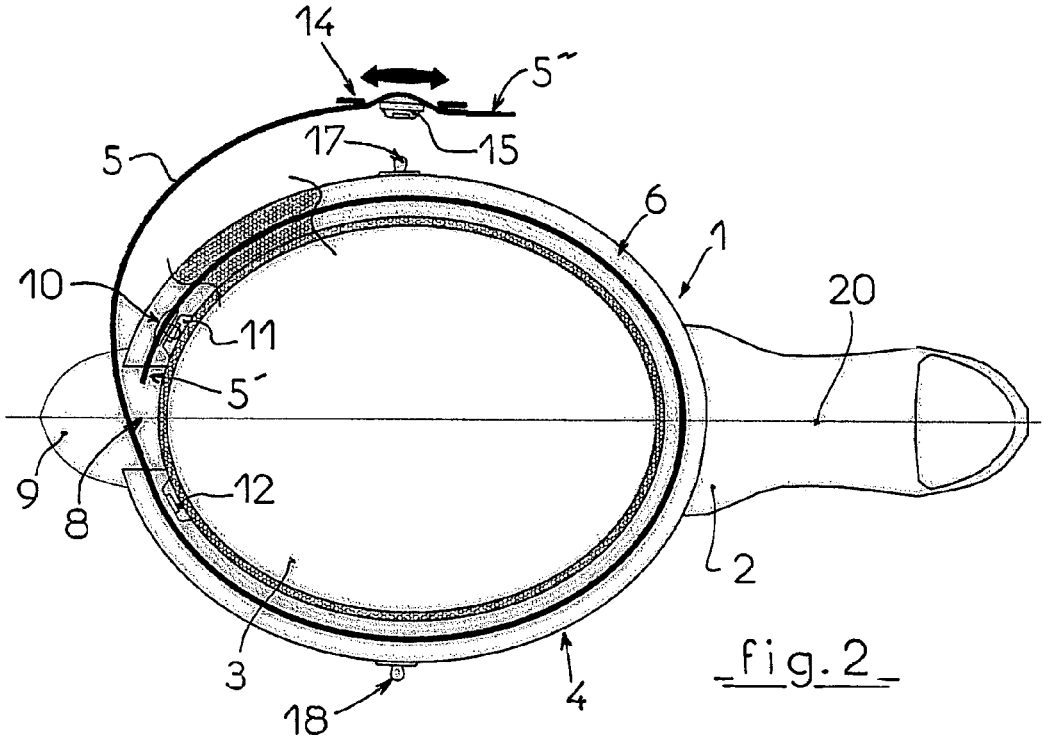
FIG. 2 shows the glove of FIG. 1, seen from the insertion opening side of the hand, prepared to fit a left hand.
Figure 3:
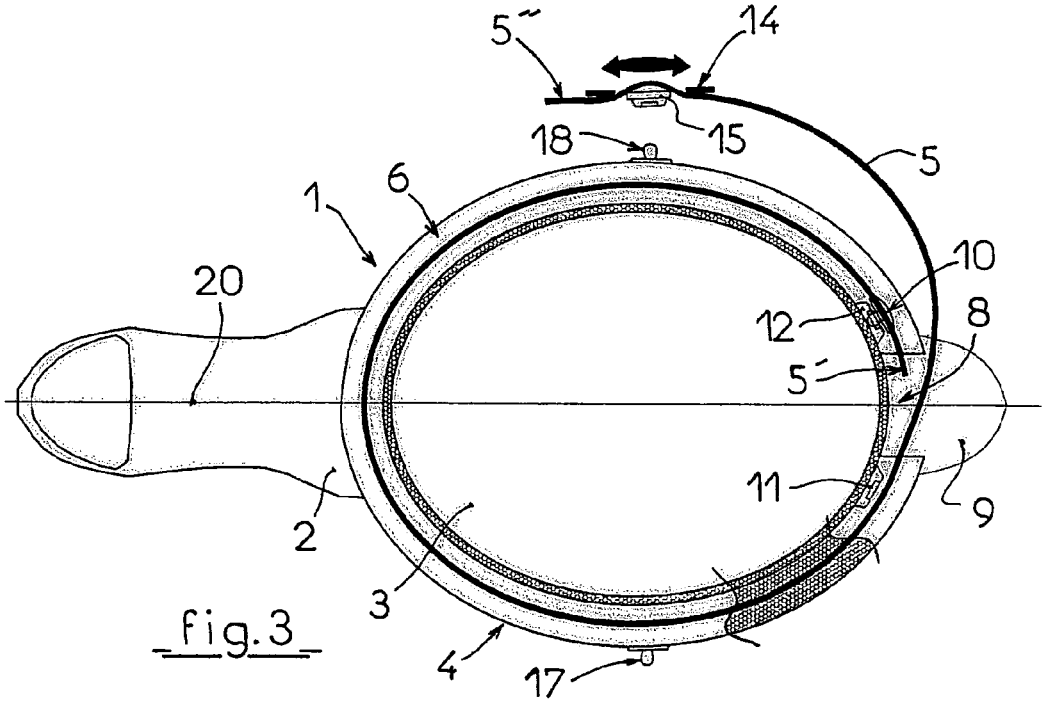
FIG. 3 is a view equivalent to FIG. 2 but showing the glove prepared to fit a right hand.

The protective glove 1 illustrated on FIGS. 1 to 3 consists of a main part 2 made of chain mail fabric designed to cover the user's hand and wrist.

At the opening 3 for inserting the hand, the terminal edge 4 of the glove 1 is in the form of a complete sleeve deprived of any lateral slit for optimum protection safety; this terminal edge 4 is slightly oversized with respect to the user's wrist in order to facilitate the introduction of the hand into the glove, and it is fitted with a mounted cinching strap 5 enabling releasable fastening of the glove around the wrist.

Such a mounted strap 5 may be made of any adapted matter, for example of plastic material, chain mail fabric, chain mail fabric coated with plastic material, flexible metal strip, metal plates, fabric or other . . .

The strap 5 is inserted in a housing in the form of a sheath of chain mails 6 provided on the terminal edge 4 of the glove. This sheath 6 is obtained by an end fold of the chain mail fabric, forming a kind of hem.

The receiving sheath 6 extends on practically the whole periphery of the terminal edge 4 of the glove. It includes an opening 8, oriented outer face side of the glove, positioned substantially in the extension of the glove finger 9 corresponding to the auricular.

This opening 8 provided in the sheath 6 has a length of the order of 2 cm; it enables to insert the strap 5 in the sheath 6, as well as taking it out, on the outer face side of the glove.

The cinching strap 5 has a length which is greater at the periphery of the user's wrist.

One of the ends 5' of the cinching strap 5 includes a male portion of snap fastener 10, in the form of a ball rivet, which is intended to catch releasably one of both female portions of snap fastener 11 or 12, in the form of spring-loaded eyebolts, attached to the chain mail fabric inside the sheath 6, just on either side of the opening 8, and oriented on the outer face side of the glove.

Both female portions of snap fastener 11 and 12 are attached to the edge of the opening 8 for easier catching of the end 5' of the strap 5.

The other end 5" of the strap 5 is fitted with a closing buckle 14, slidingly adjustable to enable the user to suit the cinching to the strength required. This closing sliding buckle 14 carries a female portion of snap fastener 15, in the form of a spring-loaded eyebolt, intended to releasably catch one of both male portions of snap fastener 17 or 18, in the form of ball rivets, attached to the outside of the sheath 6. Both male portions of snap fastener 17 and 18 are symmetrically or substantially symmetrically opposite, i.e. they are situated on either side of the glove, both at the same distance or practically the same distance from the opening 8.

As can be seen on FIGS. 2 and 3, the main part 2 made of chain mail fabric of the glove possesses a plane of symmetry 20 which runs though the axis of the glove fingers, in order to obtain the same wrapping features, regardless whether the glove is used for a right hand or a left hand.

The protective glove illustrated on FIGS. 1 to 3 may indeed be used indifferently for a right hand or a left hand, without turning said glove over, this simply while adapting the catching of the strap 5 on the terminal edge 4 in order to position the closing buckle 14 above the wrist.

In the configuration illustrated on FIG. 2, the glove 1 enables to fit a left hand. The male portion of snap fastener 10 attached to the end 5' of the strap 5 is caught on the female portion 11 of snap fastener situated inside of the sheath 6, and an adjustable closing buckle 14 with its female portion of snap fastener 15 is caught on the male portion of snap fastener 17 attached to the outside of said sheath 6, said buckle 14 being then positioned above the wrist.

The snap fastener 10–11 which is used for releasable catching of the end 5' of the strap 5 is situated on the same side of the opening 8 as the closing buckle 14, after said strap 5 goes around the wrist. Considering the tensile direction of the strap 5, this snap fastener 10–11 may not come out of the sheath 6 during cinching; consequently, it does disturb, or only slightly, the good distribution of the chain mails around the wrist during cinching, and the covering element of the strap 5 may not jeopardise the catching quality.

In the same glove configuration, the portion of snap fastener 10 which fits the end 5' of the strap 5 could be caught onto the female portion 12 of snap fastener situated on the other side of the opening 8, but when closing an adjustable buckle 14, the traction exerted on the strap might extract the snap fastener 10–12 off the sheath 6 slightly, involving the inherent shortcomings mentioned above.

To fit a right hand with the same protective glove, it suffices to release the cinching strap 5, to extract it from the sheath 6 and to reverse its positioning according to the configuration illustrated on FIG. 3.

In such a case, the male portion of snap fastener 10 attached to the end 5' of the strap 5 is caught on the female portion 12 of snap fastener, and the female portion 15 of snap fastener which fits the closing buckle 14 may be caught on the male portion of snap fastener 18, said buckle 14 being then still positioned above the wrist.

Obviously, on the embodiment illustrated, the male and female portions of snap fasteners may be reverted on their respective supports without changing anything to the catching system of the strap.

One obtains consequently a very comfortable ambidextrous glove to wear, and whereof the configuration may be modified very simply in relation to the hand to be fitted.

It should be noted that a similar structure of ambidextrous glove may be obtained by replacing certain snap fasteners, or all of them, with other types of releasable catching means, for example hooking members associated with reception orifices or others . . .

As a variation, the reception sheath of the cinching strap may be replaced with a plurality of loops, regularly spaced on the periphery of the terminal edge 4, the general structure of the glove remaining identical to that defined above.

Both portions 11 and 12 of snap fastener will then be positioned under two loops delineating the opening 8; and both portions 17 and 18 of snap fastener will be provided, for their own part, on two other loops.

Still in another embodiment variation, both portions of snap fastener 17 and 18 may be attached directly to the cinching strap 5; both these portions of snap fastener 17 and 18 are then laid out between two loops, or in appropriate openings laid out on the outside of the sheath 6, as the case may be, in order to co-operate with the matching portion 15 of snap fastener integral with an adjustable closing buckle 14.

Figure 4:
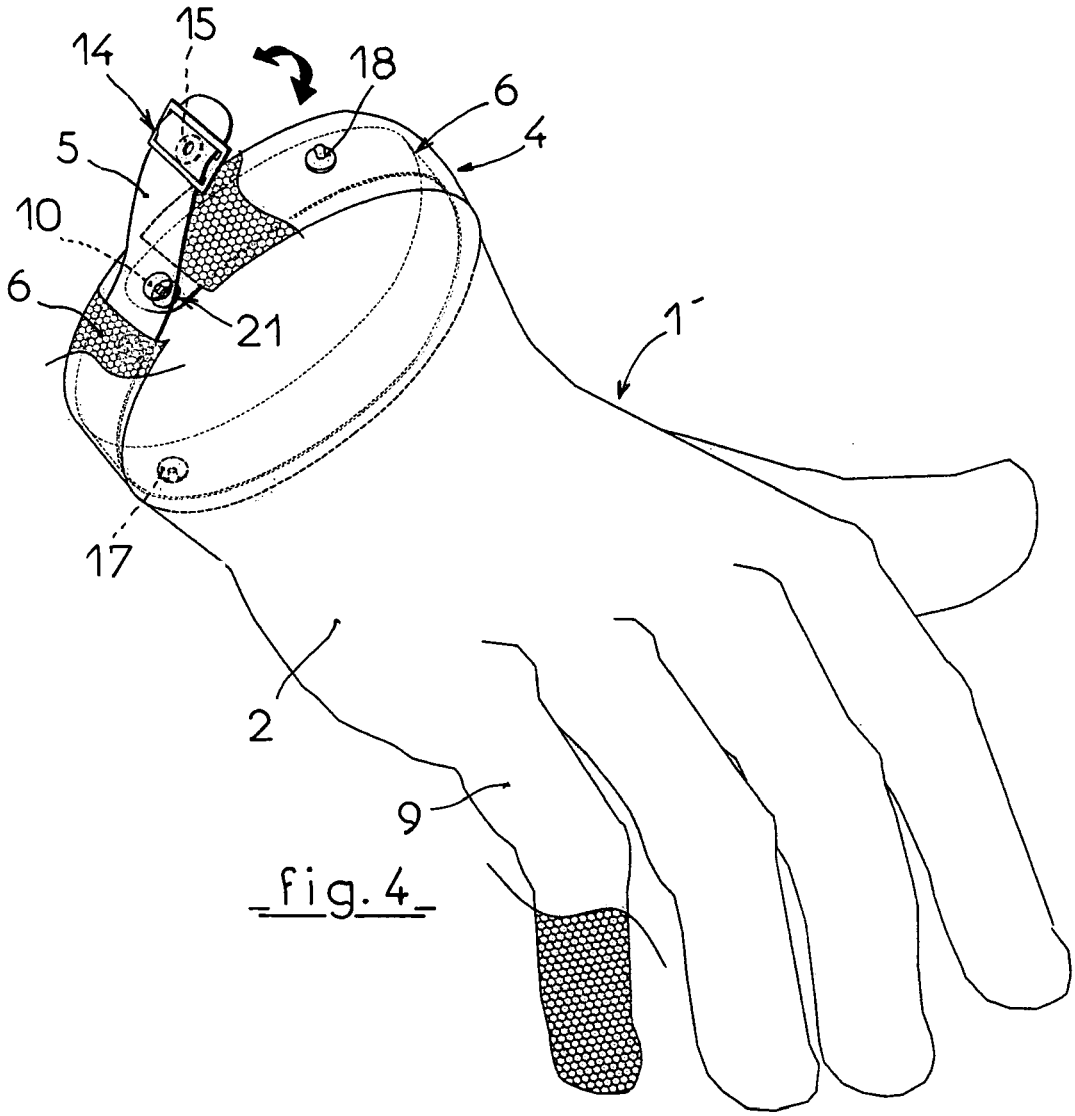
FIG. 4 shows a slight variation of the glove illustrated on FIGS. 1 to 3.

FIG. 4 illustrates an embodiment slightly different of that illustrated on FIGS. 1 to 3. The general fastening principle of the cinching strap remains identical on the glove 1' represented, but both portions of snap fastener 11 and 12 which had been provided on either side of the opening 8 in the previous embodiment, have been here replaced with a single portion of snap fastener 21 attached to the outside of the glove, in the opening 8.

Figure 5:
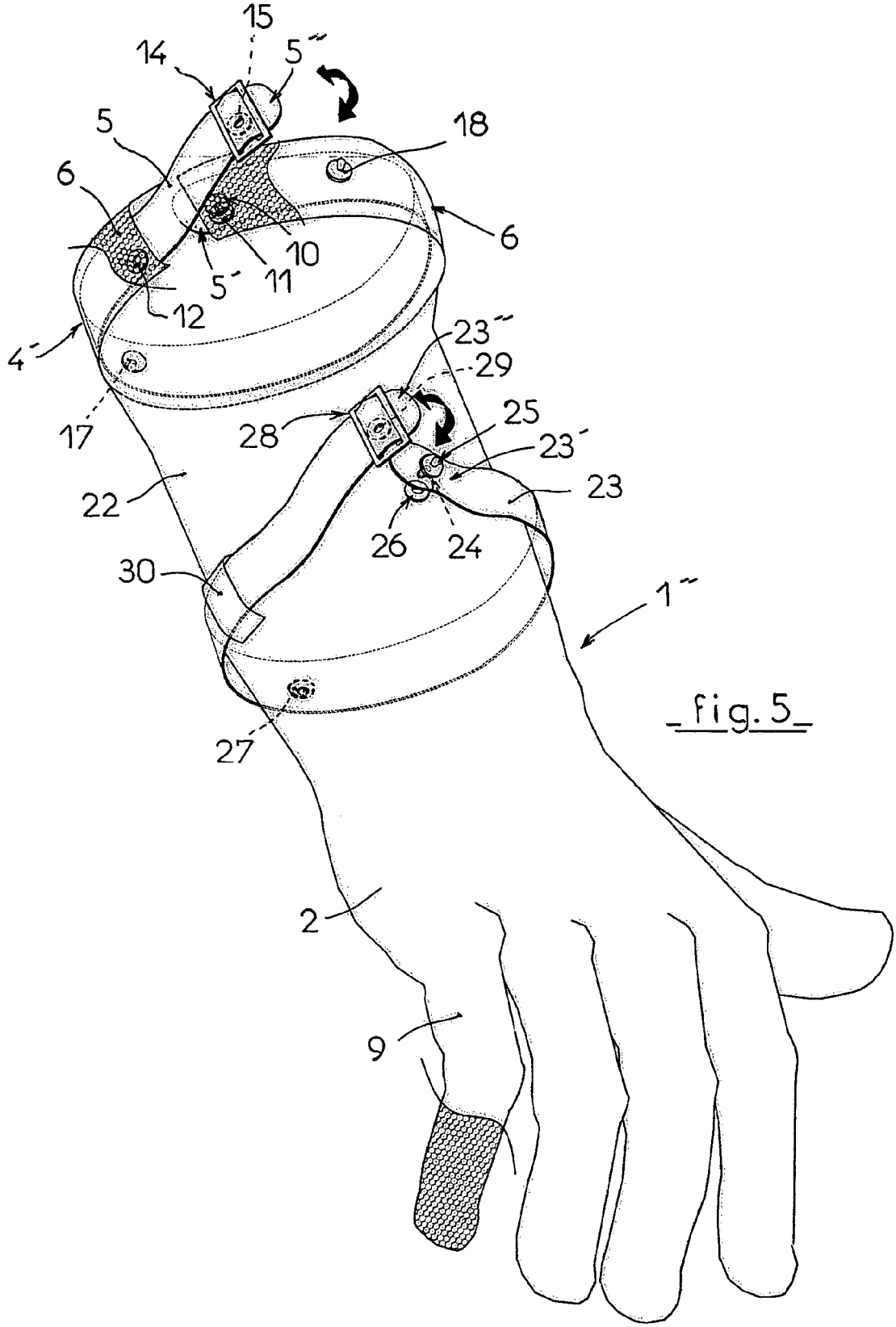
FIG. 5 represents another variation of a glove according to this invention, fitted with a protective cuff-link of the forearm.

According to an embodiment variation 1" illustrated oh FIG. 5, the main part made of chain mail 2 designed to cover the hand and the wrist is extended by a cuff-link 22 made of chain mail fabric capable of covering the user's forearm (or even the whole arm). The cuff-link made of chain mail 22 is deprived of a lateral slit; conventionally, it includes longitudinal stiffeners (non represented) which enable holding correctly the chain mail fabric on the member.

The terminal edge 4' of the glove 1" is fitted with a first cinching strap 5 whereof the holding, catching and adjustment features are identical to those described relative to the <<simple>> gloves 1 and 1' illustrated on FIGS. 1 to 4.

In this embodiment with cuff-link, the glove 1" includes a second strap 23 which fits the zone of wrist. This second strap 23 which has a greater length at the periphery of the wrist may be made of any appropriate material (plastic material, chain mail fabric . . . ), and it includes releasable catching means of both its ends 23' and 23" on the outside of the chain mail fabric of the glove, adapted to the ambidextrous nature of this glove.

The end 23' of the strap 23 includes two male portions of snap fastener 24 and 25, in the form of ball rivets, each arranged on one side of said strap. In the embodiment illustrated, both these portions of snap fastener 24 and 25 are mounted head to foot since they consist of a single part attached to the strap, but they may also consist of two independent parts, slightly offset relative to one another.

The male portion of snap fastener 24 is intended to be caught on one of two female portions of snap fastener 26 or 27 (in the form of spring-loaded eyebolts) both fixed on the outside of the chain mail fabric, but symmetrically or substantially symmetrically opposite relative to one another. The other male portion of snap fastener 25 is used for releasable catching of an adjustable buckle 28 mounted on the end 23" of the strap 23 and fitted with a matching female portion of snap fastener 29.

The catching system of the end 23' of the strap 23 on the portion 26 or 27 of snap fastener depends on the hand fitted, so that the closing buckle 28 is positioned above the wrist.

The cinching strap 5 mounted at the end of the cuff-link 22 is, for its own part, laid out so that its closing buckle 14 is placed above the forearm.

For this embodiment also, the various portions of snap fasteners may be reversed on their respective supports, without changing anything to the assembly and catching principle of the strap 23.

The holding system of the strap 23 on the zone of wrist may be completed by the presence of one or several loops 30 provided on the outside of the chain mail fabric.

For the various embodiments which have just been described, the terminal strap 5 need not be situated on the terminal edge of the glove properly speaking. It may indeed be placed a few centimetres from this terminal edge, offset towards the main part 2 of the glove, the small peripheral strip of chain mails then truly corresponding to the terminal edge of the glove being held by suitable stiffening means.

The invention claimed is:

1. Protective glove consisting of a chain mail main part designed to cover a user's hand and wrist, and possibly associated with an extension also made of chain mail designed to cover a forearm or an arm of the user, said glove includes a mounted cinching strap located in a sheath or in loops provided on a terminal edge of the glove, or close to said terminal edge said glove comprising:

at least a first releasable catching means on an outside of a fabric of the chain mail, designed to co-operate with appropriate first matching catching means provided at a first end of said strap; and at least two second releasable catching means, symmetrically or substantially symmetrically opposite on the outside of the glove, one of said second catching means being designed to cooperate with appropriate second matching catching means arranged at a second end of the strap according to the usage of the glove for protecting a right hand or a left hand, to lock tightly said strap.

2. The protective glove according to claim 1, wherein said first releasable catching means is laid out in an opening provided in the sheath to form an inlet and an outlet of the strap, or between two loops making up the inlet and outlet members of said strap.

3. The protective glove according to claim 1, wherein there are two first releasable catching means arranged inside the sheath, on either side of an opening provided in said sheath to form an inlet and an outlet of said strap, or under two loops making up the inlet and outlet members of said strap.

4. The protective glove according to claim 1, wherein there are two said second catching means provided on the sheath or on the loops of said strap.

5. The protective glove according to claim 1, wherein there are two second catching means provided on the outside of the strap, running through appropriate openings provided in the sheath or between two of said loops.

6. The protective glove according to claim 1, wherein said first releasable catching means includes a portion of a snap fastener provided in an opening of the sheath and is used for attaching the first end of said strap fitted with a matching portion of snap fastener and said two second catches, wherein one of said second catches cooperates with a matching portion of snap fastener positioned on an adjustable buckle integral with the second end of the strap.

7. The protective glove according to claim 1, wherein said first releasable catching means includes two identical portions of snap fastener provided in the sheath, on either side of an opening provided in said sheath, wherein one of said two identical fasteners is used for attaching the first end of said strap fitted with a matching portion of snap fastener and two of said second releasable catching means, wherein one of said second releasable catching means co-operates with a matching portion of snap fastener positioned on an adjustable buckle integral with the second end of the strap.

8. The protective glove according to claim 1, wherein said first releasable catching means is situated substantially in a same plane as an extension of the glove finger designed to receive the auricular.

9. The protective glove according to claim 1, further comprising an extension made of chain mail designed to cover the user's forearm or the arm, and including a second cinching strap at a user's wrist, said glove includes a first releasable catching means at a first end of said second strap and a second releasable and adjustable catching means of tho at a second end of said second strap.

10. The protective glove according to claim 9, wherein one of the ends of the second strap is fitted with two identical portions of snap fastener, mounted on either side of said strap, one of these portions of snap fastener being designed to co-operate with one of two matching portions of snap fastener laid out symmetrically or substantially symmetrically on the outside of the glove, and the other portion of the two identical portions of snap fastener being designed to co-operate with a matching portion of snap fastener laid out on an adjustable buckle integral with the second end of said second strap.

11. The protective glove according to claim 1, wherein said glove possesses a plane of symmetry running through an axis of five fingers of the glove.

12. The protective glove according to claim 1, wherein the terminal edge is in the form of a complete sleeve deprived of any lateral slit.

13. An ambidextrous protective glove, comprising:

a chain mail main part for covering a user's hand and wrist;

a sheath at or near a terminal edge of the glove;

a cinching strap located in said sheath;

a first releasable catch on an outside of the chain mail part that co-operates with a first mating catch at a first end of said strap; and at least two second releasable catches that are substantially symmetrically opposite each other on the outside of the glove and that co-operate with a mating second catch for a right-hand configuration and a mating third catch for a left hand configuration, said second and third mating catches being at a second end of the strap.

14. The protective glove according to claim 13, wherein said first releasable catch is laid out in an opening provided in the sheath to form an inlet and an outlet of the strap.

15. The protective glove according to claim 13, wherein said first releasable catch includes two first releasable catches arranged inside the sheath on either side of an opening provided in said sheath to form an inlet and an outlet of said strap.

16. The protective glove according to claim 13, wherein there are two said second catches provided on the sheath.

17. The protective glove according to claim 13, wherein said first catch comprises a snap fastener provided in an opening of the sheath and wherein one of the second catches co-operates with a mating snap fastener positioned on an adjustable buckle integral with the second end of the strap.

18. The protective glove according to claim 13, further comprising:

an extension made of chain mail designed to cover a user's forearm or arm; and a second cinching strap at a user's wrist, a first releasable catch being at a first end of said second strap and a second releasable and adjustable catch being at a second end of said second strap.

19. The protective glove according to claim 18, wherein the first end of the second strap is fitted with two snap fasteners mounted on either side of said second strap, a first one of said snap fasteners being designed to co-operate with one of two mating snap fasteners that are substantially symmetrically on the outside of the glove, a second one of said snap fasteners being designed to co-operate with a mating snap fastener laid out on an adjustable buckle integral with the second end of said second strap.

20. An ambidextrous protective glove, comprising:

a chain mail main part for covering a user's hand and wrist;

a sheath adjacent a terminal edge of said glove;

a cinching strap located in said sheath;

a first releasable catch on a first side of the chain mail part that cooperates with a first mating catch at a first end of said strap; and at least two second releasable catches that are substantially symmetrically opposite each other on said first side of the glove and that co-operate with a mating catches at a second end of said strap, said glove being ambidextrous without turning said glove inside out.

* * * * *